US008479759B2

(12) United States Patent
Benvenuto et al.

(10) Patent No.: US 8,479,759 B2
(45) Date of Patent: Jul. 9, 2013

(54) DEVICE FOR CONTROLLING THE SUPPLY OF A COMBUSTIBLE GAS TO A BURNER APPARATUS

(75) Inventors: Michele Benvenuto, Mogliano Veneto (IT); Salvatore Pappalardo, Padua (IT); Gianpiero Turrin, Padua (IT)

(73) Assignee: Sit La Precisa S.p.A. Con Socio Unico, Padova (IT)

( * ) Notice: Subject to any disclaimer, the term of this patent is extended or adjusted under 35 U.S.C. 154(b) by 136 days.

(21) Appl. No.: 13/045,217

(22) Filed: Mar. 10, 2011

(65) Prior Publication Data

US 2011/0226355 A1 Sep. 22, 2011

(30) Foreign Application Priority Data

Mar. 22, 2010 (IT) ..... PD2010A0089

(51) Int. Cl.
*F23D 14/72* (2006.01)

(52) U.S. Cl.
USPC ..... 137/65; 137/66; 137/78.4; 431/278; 431/281

(58) Field of Classification Search
USPC ..... 137/65, 66, 78.4
See application file for complete search history.

(56) References Cited

U.S. PATENT DOCUMENTS 1,966,735 A * 7/1934 Sackett ..... 137/65
3,348,561 A * 10/1967 MacLennan ..... 137/66
3,502,835 A * 3/1970 Batcheller ..... 200/469
3,971,904 A * 7/1976 Ward ..... 200/6 BB
3,975,135 A * 8/1976 Kinsella et al. ..... 431/43
4,002,872 A * 1/1977 Desio ..... 200/294
4,080,154 A * 3/1978 Kinsella ..... 431/43
4,249,047 A * 2/1981 Huff et al. ..... 200/61.86
4,429,705 A * 2/1984 Ritchart ..... 137/65
4,543,974 A * 10/1985 Dietiker et al. ..... 137/66
4,850,530 A * 7/1989 Uecker ..... 236/1 EB
5,193,993 A 3/1993 Dietiker (Continued)

FOREIGN PATENT DOCUMENTS

DE 102008027546 A1 12/2007
EP 0159393 A1 10/1985

(Continued)

*Primary Examiner* — Eric Keasel
*Assistant Examiner* — Minh Le
(74) *Attorney, Agent, or Firm* — Volpe and Koenig, P.C.

(57) ABSTRACT

A device for controlling a combustible gas supply to a burner is provided, which includes first and second servovalves, having respective valve seats associated with a corresponding shut-off mechanism, which include respective first and second control solenoid valves with an electromagnetic operating device that controls the opening/closing of the corresponding servovalve. The solenoid valves act to indirectly control the corresponding servovalve's respective shut-off mechanism. The pipes of the control are in communication with the main pipe through an auxiliary bleed pipe. A pilot pipe is branched from the auxiliary pipe to supply a pilot burner, and a thermoelectric magnetic unit with a knob is provided on the auxiliary pipe, which allows gas to flow towards the pilot burner when the unit is activated, while simultaneously shutting off the flow of gas towards the servovalve control circuit. The device includes a control mechanism, controlled by the knob, which controls gas flow.

6 Claims, 8 Drawing Sheets

U.S. PATENT DOCUMENTS

Figure 1:
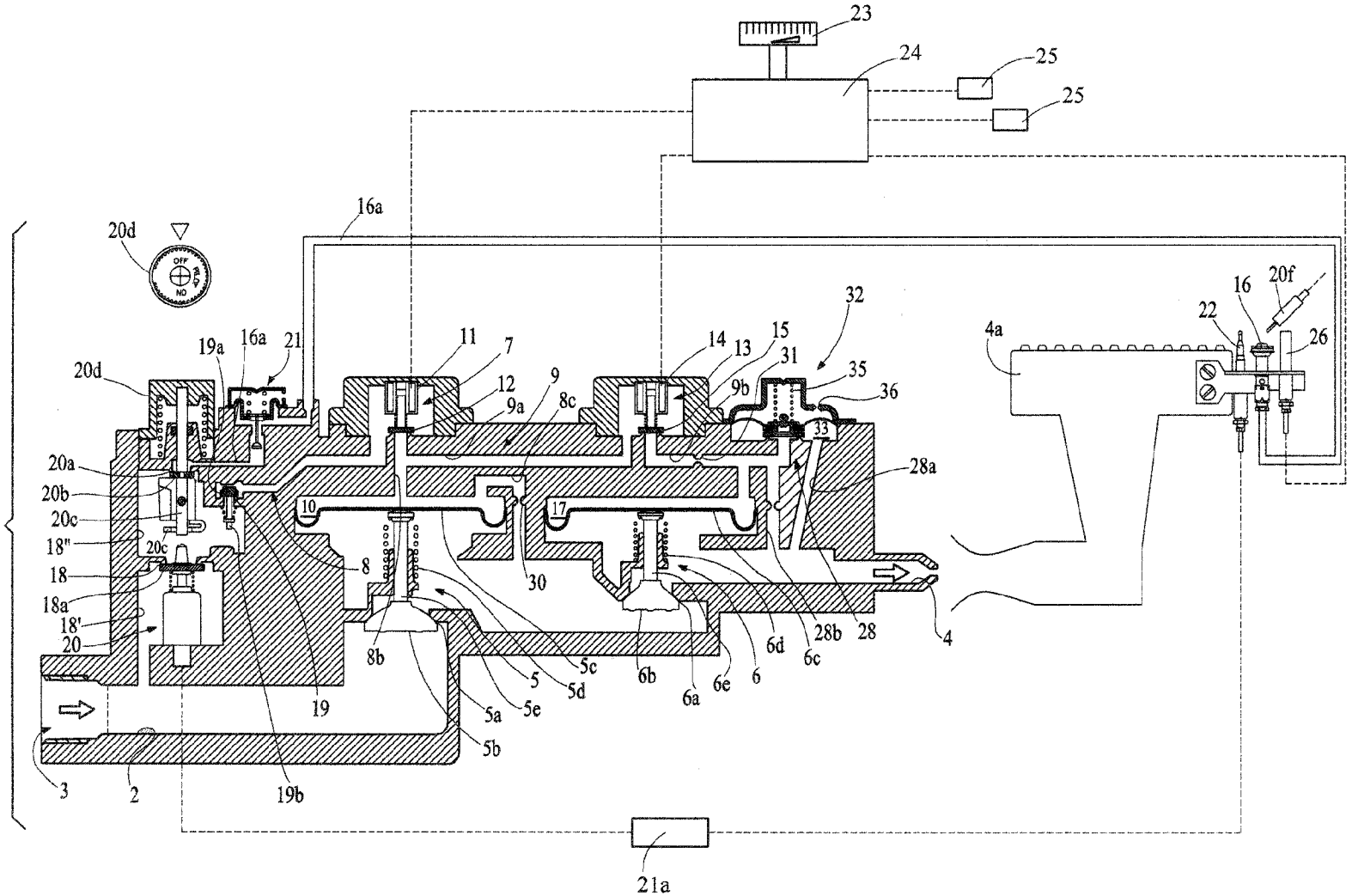

| | | | | |
|---|---|---|---|---|
| 5,203,688 | A * | 4/1993 | Dietiker | 431/51 |
| 5,979,484 | A * | 11/1999 | Grando et al. | 137/66 |
| 6,571,829 | B2 * | 6/2003 | Kuriyama et al. | 137/630.2 |
| 6,604,538 | B2 * | 8/2003 | Schmotzer et al. | 137/1 |
| 6,968,853 | B2 * | 11/2005 | Amazorrain | 137/66 |
| 7,252,109 | B2 * | 8/2007 | Colombo | 137/66 |
| 7,523,762 | B2 * | 4/2009 | Buezis et al. | 137/613 |
| 7,902,476 | B2 * | 3/2011 | Querejeta Andueza et al. | 200/569 |
| 8,162,002 | B2 * | 4/2012 | Pavin et al. | 137/613 |
| 2006/0207654 | A1 * | 9/2006 | Huang | 137/66 |

FOREIGN PATENT DOCUMENTS

| | | | |
|---|---|---|---|
| EP | 1058060 | A1 | 12/2000 |
| FR | 1361443 | A | 5/1964 |
| WO | 2007060696 | A1 | 5/2007 |
| WO | 2008012849 | A1 | 1/2008 |

* cited by examiner

DEVICE FOR CONTROLLING THE SUPPLY OF A COMBUSTIBLE GAS TO A BURNER APPARATUS

The present invention relates to a device for controlling the supply of a combustible gas to a burner apparatus, according to the features described in the preamble of Claim 1, which is the principal claim.

The invention relates more specifically, but not exclusively, to the field of devices for the multifunctional control of the supply of combustible gas in valve units for use in heating apparatus such as water heaters, room heaters, fires and the like.

In a typical known device of this kind, a thermocouple-controlled magnetic safety unit with a manual activation system is associated with a servovalve having an electromagnetic operating device for controlling a servo-assisted gas circuit (the servo circuit), the power supply to this system being provided by a thermopile heated in parallel with the thermocouple of the pilot burner.

In other applications, the power required for operation can be obtained from systems for recovering energy from the environment or from the apparatus itself.

In some applications, however, the supply control device has to be provided with a pair of automatic safety valves in order to meet statutory safety requirements. One example is that of domestic water heaters, in which the heater has a draught regulating valve in the flue, also known as a "flue damper", which acts as a draught shut-off device in the exhaust fume vent pipe.

In this application, there is a known way of providing a pair of servo-assisted valves, positioned in series along the main gas passage, in which each safety valve (of the on-off type) is a servovalve with an electromagnetic operating device for controlling the corresponding servo circuit. In this configuration, since the solenoid valves with electromagnetic operating devices which control the servo circuits for the servovalves act by opening and closing small gas passages (in the control circuit), their power absorption is rather small, and therefore they may be considered for use, in this case, with thermoelectric devices for generating the power required for operation, or with equivalent devices.

With this solution, however, since there has to be a pressure drop between the sections upstream and downstream of the corresponding valves in order to ensure correct operation (the opening of the valve shut-off member) in each of the servovalves, a configuration of this type, in which the individual pressure drops are additive, results in a double pressure drop which affects the characteristics of the supply flow rate, and may therefore be unacceptable in normal applications.

A further solution, described in International Patent Application WO2007/060696 in the name of the present applicant, is intended to partially remedy the aforementioned drawbacks. In the device described therein, the intake pipes of the corresponding control circuits for picking up the pressure signal to be transmitted to the corresponding control chamber are both connected, in fluid communication, to the main pipe, upstream of the first servovalve. Although this configuration enables the pressure drop between the sections upstream and downstream of the pair of servovalves to be limited to a single pressure drop, with evident functional benefits, it is less suitable for use in apparatus of the aforesaid type provided with a flue damper. This is because, in the known device, the pilot pipe is supplied only after the first servovalve has been opened. In heating apparatus provided with flue dampers, the safety regulations require that each of the servovalves, which are in series with each other, should be controllable to open and close the main gas passage for each heating cycle in a way which is functionally independent of the flame produced by the pilot burner, and this functionality cannot be guaranteed by the aforesaid known device.

The object of the present invention is to provide a device for controlling the supply of a combustible gas to a burner apparatus, whose structural and functional design is such that the limitations of the aforementioned prior art can be overcome.

This object is achieved by the invention by means of a device for controlling the supply of a combustible gas to a burner apparatus, constructed in accordance with the claims set out below.

Figure 2:
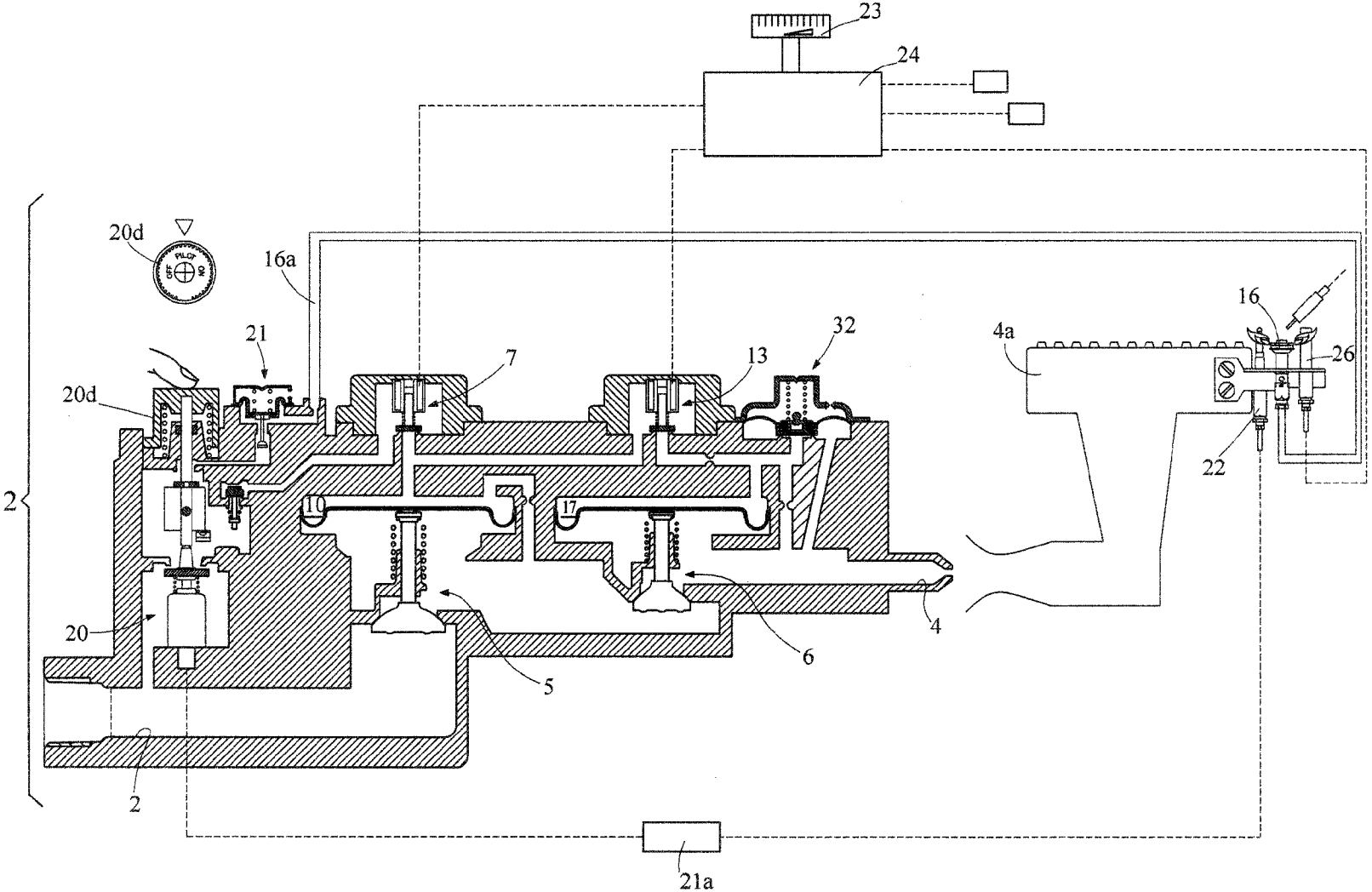
Figure 3:
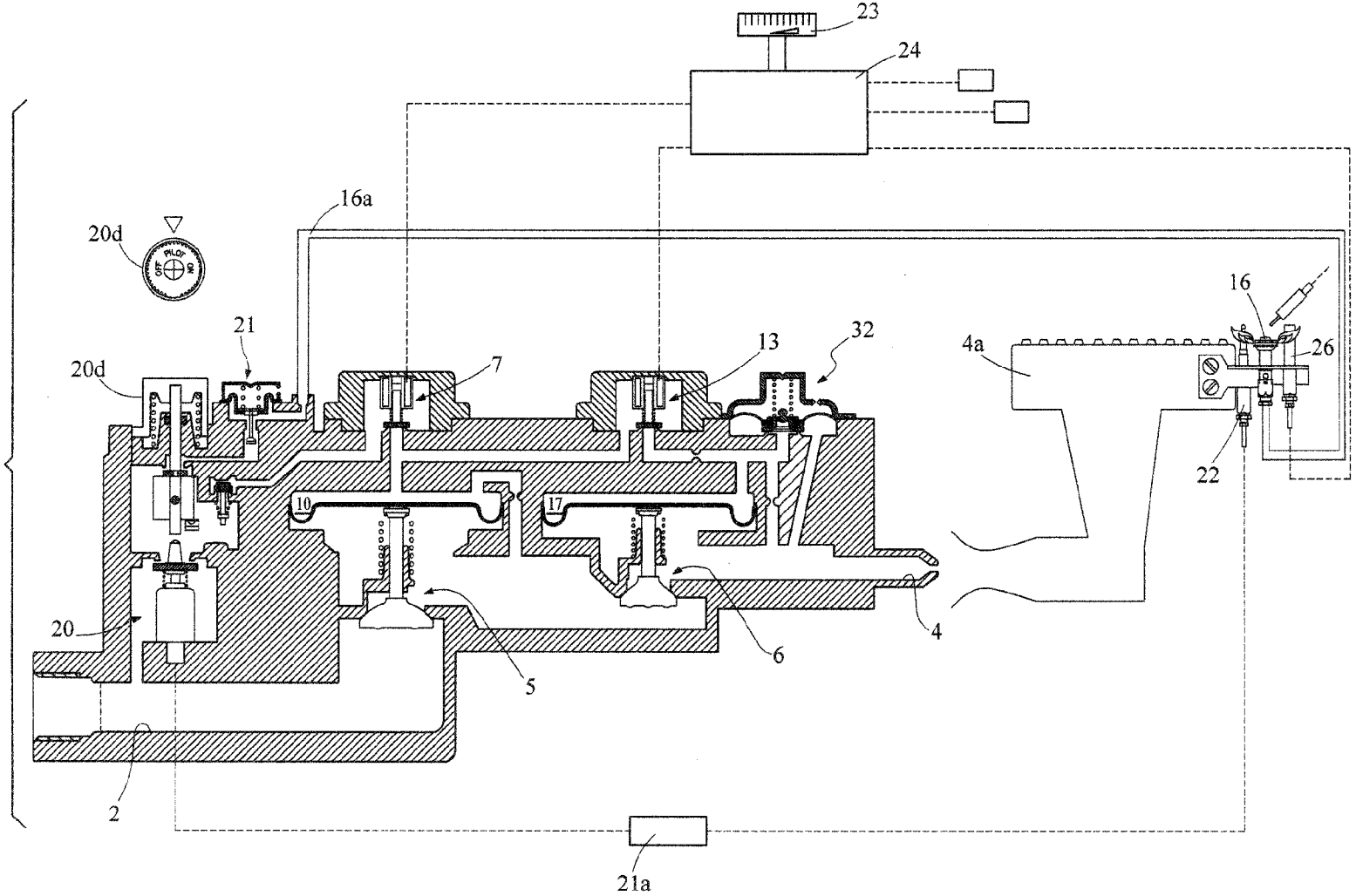
Figure 4:
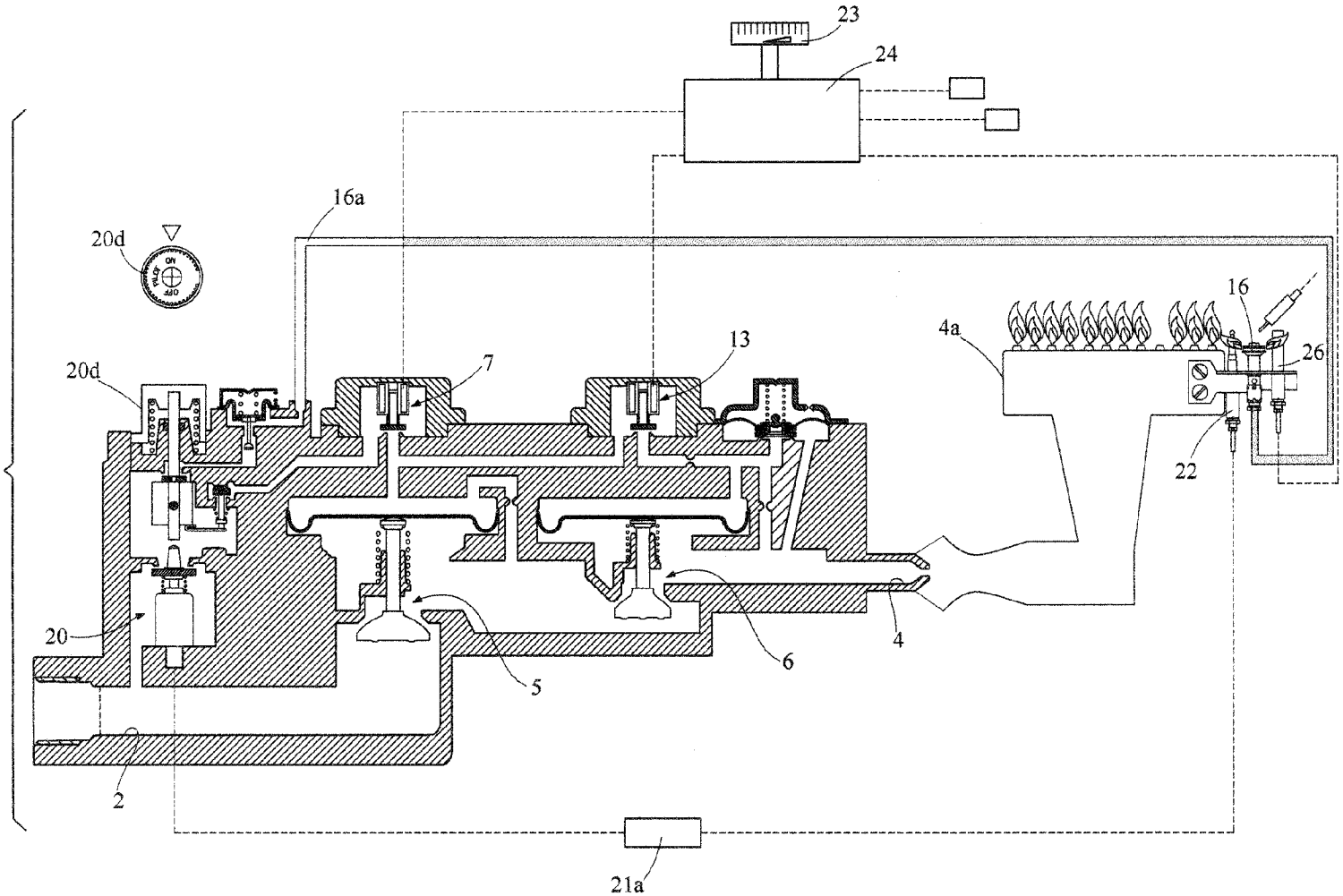

Other features and advantages of the invention will be made clear by the following detailed description of some preferred examples of embodiment thereof, illustrated, for the purposes of guidance and in a non-limiting way, with reference to the appended drawings, in which:

FIG. 1 is a schematic view, in longitudinal section, of a first example of a device made according to the present invention, FIGS. 2 to 4 are schematic views corresponding to that of FIG. 1 in different stages of operation of the aforesaid device, and FIGS. 5 to 8 are schematic views in longitudinal section of a second example of a device according to the invention, in different stages of operation.

With reference to FIGS. 1 to 4 initially, the number 1 indicates the whole of a device for controlling the supply of a combustible gas to a burner apparatus of a domestic water heater, constructed according to the present invention. The device 1 comprises a valve unit positioned in a main gas supply pipe 2, between a gas inlet section 3 and an outlet section 4 where the gas is supplied to a main burner 4*a*.

Along the main pipe 2 there are a first and a second servovalve, indicated by 5 and 6 respectively, positioned in cascade with each other in such a way that the servovalve 6 is downstream of the servovalve 5 with respect to the direction of the gas flow supplied through the pipe 2.

Each servovalve 5, 6 comprises a corresponding servo circuit including a corresponding valve seat 5*a*, 6*a* associated with a corresponding shut-off member 5*b*, 6*b* controlled by a diaphragm 5*c*, 6*c*, for opening the seats 5*a*, 6*a* in opposition to corresponding resilient return means such as corresponding springs 5*d*, 6*d*.

Both of the servovalves 5, 6 act as on-off valves for closing the main gas passage for safety reasons, as will be explained in the following description.

The first servovalve 5 is associated with a control solenoid valve for the servo-assistance circuit, indicated by 7, arranged to open or close an auxiliary control pipe 8 of the servo circuit, which forms the intake pipe for the pressure signal to be transmitted to the control chamber of the servo circuit. The diaphragm 5*c* acts directly on the control rod 5*e* of the shut-off member 5*b*, which is pushed by the spring 5*d* to close the seat.

One side of the diaphragm 5*c* delimits a control chamber 10 which communicates with the main pipe 2, upstream of the servovalve seat 5, through the pipe 8.

More specifically, the pipe 8 includes a first part 8*a*, extending upstream of the solenoid valve 7, and a second part 8*b* which is a continuation of the first part, extending downstream of the solenoid valve 7 and communicating with the chamber 10.

In the solenoid valve 7, the corresponding part of pipe 8 is selectively opened or closed by an electromagnet 11, of the on-off type with a resilient return means, acting on a shut-off element 12 which is associated with the passage cross section of the pipe 8 and which can be moved to and from a position in which the passage cross section is shut off.

A control pipe 9 for the second servovalve 6 is branched from, and in fluid communication with, the second part 8*b* of the pipe 8. More specifically, the pipe 9 comprises a first part 9*a*, communicating with the part 8*b*, and a second part 9*b*, in continuation of the first part 9*a*, communicating with the corresponding control chamber 17 of the second servovalve. A second solenoid valve 13, for the servo control of the second servovalve 6, is positioned between parts 9*a* and 9*b* of the pipe 9.

In the solenoid valve 13, the corresponding part of pipe 9 is selectively opened and closed by an electromagnet 14, of the on-off type with a resilient return means, acting on a shut-off element 15 which is associated with the passage cross section of the pipe 9 and which can be moved to and from a position in which the passage cross section is shut off.

The pipe 9, together with the part of pipe 8 communicating with it, acts as the intake pipe for the pressure signal to be transmitted to the control chamber 17 of the corresponding servo circuit, the chamber 17 being delimited by one side of the diaphragm 6*c*.

It should be noted that both intake pipes 8, 9 of the control chambers 10, 17 respectively are connected, in fluid communication, to the main pipe 2, upstream of the first servovalve 5, through the first part of the pipe 8.

Alternatively, it is possible to provide a configuration in which the pipe 9 is connected directly to the first part of the pipe 8, in such a way that the solenoid valve 13 is supplied directly, in what is known as a "parallel" arrangement instead of the "series" arrangement shown in the drawings.

According to a principal feature of the invention, the valve unit 1 comprises an auxiliary gas line, branched from the main line which supplies both a pilot burner 16 and the control circuits of the servovalves 5, 6 positioned in series in the main gas passage.

With particular reference to FIG. 2, the auxiliary line has a pilot pipe 16*a* branched from the intake pipe 8 to supply the pilot burner 16.

Starting at the section which communicates with the main pipe 2, the auxiliary pipe includes a first portion 18' extending into a second portion 18" through an interposed valve seat 18, which is acted on by a manually activated thermoelectric magnetic safety unit 20, including a shut-off member 18*a* which is held in the open position of the seat 18 by the energizing of the magnetic unit due to the thermocouple voltage when a flame is present at the pilot burner 16.

The portion 18", extending downstream of the seat 18, is connected both to the pilot pipe 16*a*, through an interposed valve seat 20*a*, and to the intake pipe 8 of the control circuit, through a corresponding interposed valve seat 19.

A shut-off member 20*b* fixed to the control rod 20*c* of a knob element 20*d* of the magnetic unit acts on the valve seat 20*a*.

The valve seat 19 is opened and closed by the action of a shut-off member 19*a* with resilient return means, the movement of this member to open the seat being caused, in opposition to the action of a return spring, by the action of an appendage 20*e* projecting from the rod 20*c* of the knob 20*d*, this appendage being capable of contacting, in a predetermined angular position of the knob, a rod 19*b* of the shut-off member 19*a*, thus moving the latter to open the valve seat 19.

Each of the drawings includes a view of the knob 20*d* from above, showing the angular position assumed by it (OFF, PILOT, ON).

The knob element 20*d* is connected to the actuating rod 20*c* for the manual activation of the safety unit, in a known way, by means of which an ignition device 20*f* (such as a piezoelectric device) associated with the pilot burner 16 is operated in the activation position (PILOT). The knob 20*d* can also be switched to the closed position (OFF) in which the valve seats 18 and 20*a* are shut off by the corresponding shut-off members of the magnetic safety unit.

The number 21 indicates a diaphragm-controlled pressure regulator for regulating the gas pressure in the pilot pipe 16*a* which supplies the pilot burner 16.

The valve unit also comprises a fusible safety element, identified by 21*a* and shown purely schematically in FIG. 2, placed in series with a thermocouple 22 associated with the pilot burner 16 in operation.

The fusible element 21*a* is designed to break the circuit if the temperature becomes excessive, thus shutting off the supply of gas to the pilot line and to the servo control circuits.

The number 23 indicates a temperature selection knob, associated for operation with a circuit on an electronic control board 24 which can process the incoming signals on the basis of preselected programs and operating modes, in order to supply the control signals to the servovalves 5, 6. The signals entering the circuit board 24 include those sent by one or more temperature sensors 25. A thermopile 26, associated in a suitable way with the pilot burner 16, is provided for the supply of power to the electronic circuit board 24.

Alternatively, means can be provided for recovering electrical energy from the apparatus itself or from the environment (using photovoltaic cells, microturbines, or the like) for supplying the circuit board 24.

Returning to the servo-assistance circuit, the control chamber 10 is also connected to a section of the main pipe 2 located between the valve seats 5*a*, 6*a*, through a pipe 8*c*, in which a constriction 30 is also provided.

The number 31 indicates a second constriction provided in part 9*b* of the pilot pipe 9.

The second pilot chamber 17 is connected to the outlet section 4 of the main pipe 2, downstream of the valve seat 6*a* of the second servovalve, through a corresponding discharge pipe 28, in which a pressure regulator, indicated as a whole by 32, can also be provided.

This is a diaphragm-type pressure regulator, of a conventional type, in which one side of a diaphragm delimits a control chamber 33 which communicates, through part 28*a* of the pipe 28, with the outlet section 4 of the main pipe 2 (downstream of the servovalve 6), and which can also shut off the outlet section of the other part 28*b* of the pipe 28 communicating with the control chamber 17. The opposite side of the diaphragm is acted on by a calibration spring 35 positioned in a chamber which is open to the atmosphere through an aperture 36. The pressure regulator 32 is designed to react to the variations in the supply pressure and to compensate for these, and also to return the pressure to a calibrated value predetermined by regulating the spring 35. The pressure regulator 32 can also be designed with a pressure modulation function, for example as a modulating regulator of the electromagnetic or pneumatic type, using linear actuators of the "voice coil" type, for example, in the first case.

In use, when the valve unit 1 shown in FIG. 1 is inoperative, with the knob in the OFF position, the electromagnets 11, 14 are de-energized, the intake pipes 8, 9 communicating with the control chambers are shut off (by the solenoid valves 7, 13 respectively), and the resilient return action of the springs 5*d*, 6*d* closes both valve seats 5*a*, 6*a* of the corresponding servovalves. In this condition, the knob 20*d* is in the closed position, with the valve seat 20*a* shut off, and the electromagnet of the magnetic safety unit 20 is de-energized (because no flame is present at the pilot thermocouple), and therefore the valve seat 18 is shut off.

When a burner ignition request is received, the magnetic safety unit 20 is first activated, with the opening of the valve seat 18 and the simultaneous ignition of the pilot burner 16. In this stage (shown in FIG. 2, with the knob set to PILOT), the gas flows exclusively along the pilot pipe 16*a*, by the bleeding of gas from the inlet section 3 along the portions 18' and 18" of the auxiliary pipe and through the seats 18 and 20*a*. In this stage of the ignition of the pilot burner, the intake pipes 8, 9 are both still closed for the flow of gas, by the action of the shut-off member 19*a* which shuts off the seat 19, thus causing the valve seats 5*a*, 6*a* to be closed.

When the unit 20 has been activated by the energizing of its electromagnet by the voltage generated by the thermocouple 22 which is heated by the flame at the pilot burner 16, following the correct ignition of the pilot burner (the stage shown in FIG. 3), the main burner 4*a* is ignited, in accordance with the program mode or the temperature selected by the knob element 23. For this purpose, the knob is first rotated to the ON position shown in FIG. 4, in which the appendage 20*e* interferes with the rod 19*b* and thus moves it, in opposition to the return spring combined with it, causing the valve seat 19 to open and causing gas to flow in the intake pipe 8 of the auxiliary line to supply the servovalve control circuit.

The energizing of the electromagnet 11 allows gas to flow in the part 8*b* of the pipe 8, enabling the servovalve 5 to open, under the control of the pressure accumulated in the control chamber 10 through the intake pipe 8.

The energizing of the electromagnet 13 causes the portion 9*b* of the intake pipe 9 to be opened for the flow of gas, and a corresponding pressure is generated in the control chamber 17, this pressure being correlated with the inlet pressure as a function of the constriction 31. Thus the diaphragm 6*c*, which is acted on by the aforesaid pressure, tends to raise the corresponding shut-off member 6*b* from its seat 6*a*, allowing gas to flow through the main pipe 2 to the main burner 4*a* (FIG. 4).

The supply pressure is also regulated by the diaphragm-type pressure regulator 32.

It should be noted that, since the control pressure of both valves 5 and 6 is obtained from a section of the main pipe upstream of the first servovalve 5, it is possible to provide a pressure drop between sections 3 and 4 of the main pipe 2 which is substantially equal to that required to open a single servovalve correctly. Thus a single pressure drop can be used to open both servovalves 5 and 6. Alternatively it is possible to produce servo control diaphragms with smaller dimensions, resulting in smaller overall dimensions, while maintaining the same closure forces acting on the shut-off members of the valves 5, 6. Moreover, owing to the positioning of the magnetic safety unit in the auxiliary line for picking up the servovalve control signal, it is possible to reduce the pressure drop along the main gas passage.

It should also be noted that the two servovalves 5, 6 can both be designed as safety valves for shutting off the main gas passage, independently of the pilot burner line.

This is particularly advantageous in applications in which the presence of two automatic safety valves is required. An example is the use of the device in a domestic water heating device provided with a draught diverter in the combustion fume exhaust flue, known in the art as a "flue damper". In this application, it is particularly necessary for the two valves on the main gas pipe to act to close the gas passage regardless of whether or not a flame is present at the pilot burner. The device according to the present invention is capable of closing both servovalves even if a flame is present at the pilot burner.

FIGS. 5 to 8 are schematic illustrations of a second example of a device according to the invention, in which parts similar to those of the preceding example are identified by the same reference numerals.

The main difference between this example and the preceding one is that no shut-off means 19*a* is provided in the auxiliary pipe, the flow of gas to the control circuit of the servovalves 5, 6 being controlled by an electric switch means 40 associated for operation with the knob 20*d*, by means of which the power supply circuit for the solenoid valves 7, 13 can be opened or closed.

More specifically, the knob 20*d* is provided with an appendage 41 which can interfere with the switch 40 when the knob is rotated to the ON position, the activation of the switch causing the closure of the power supply circuit of the electromagnets 11, 14 and the consequent opening of the solenoid valves 7, 13. On the other hand, in all the other positions of the knob, if there is no contact between the appendage 41 and the switch 40, the power supply circuit is opened because the electromagnets 11, 14 are de-energized, thus shutting off the gas flow in the servovalve control circuit.

As an alternative to the projecting appendage 41, the knob 20*d* can be shaped suitably so as to interact with the switch 40, to activate the latter in the same way as described above.

Figure 5:
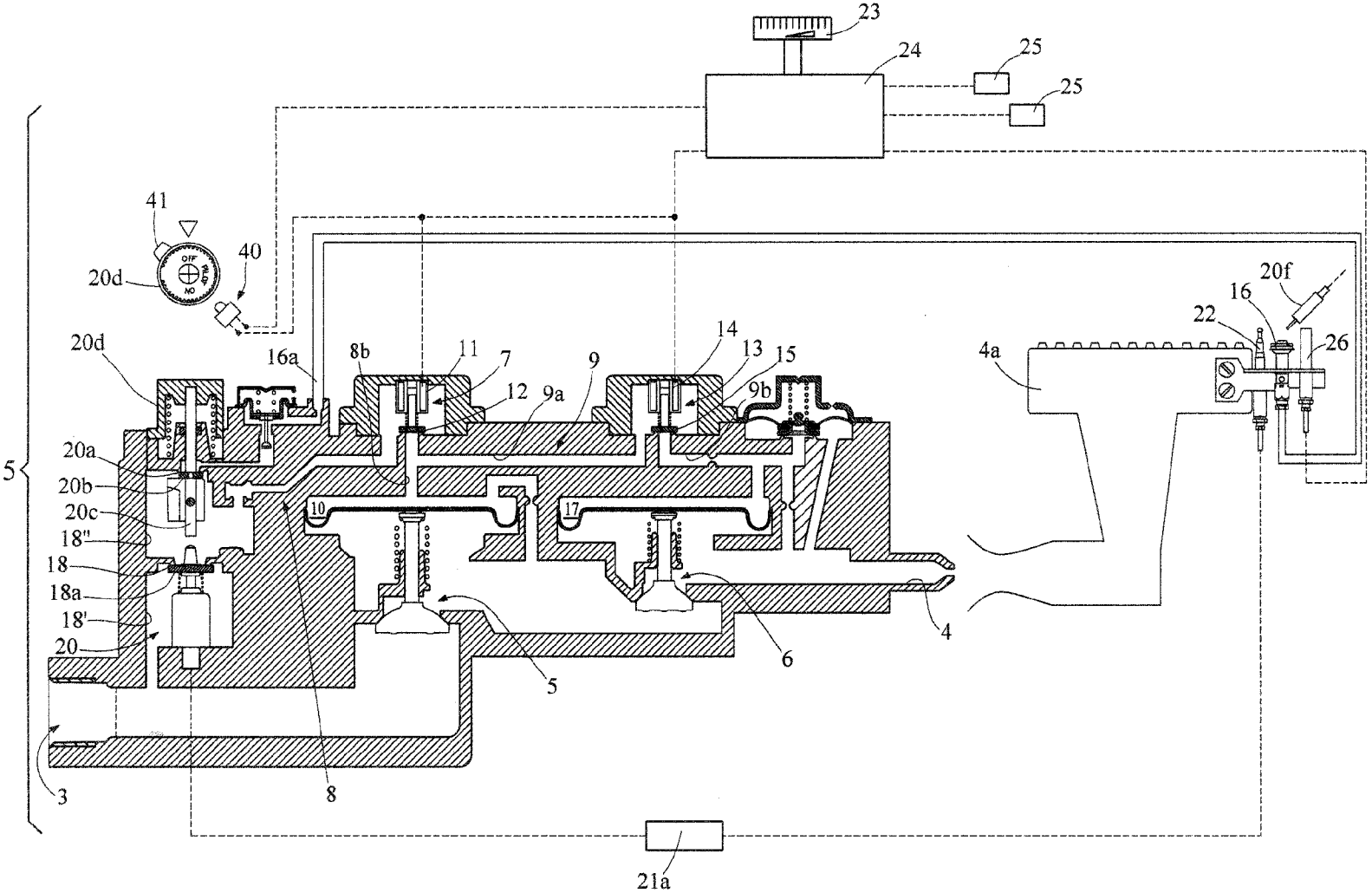
Figure 6:
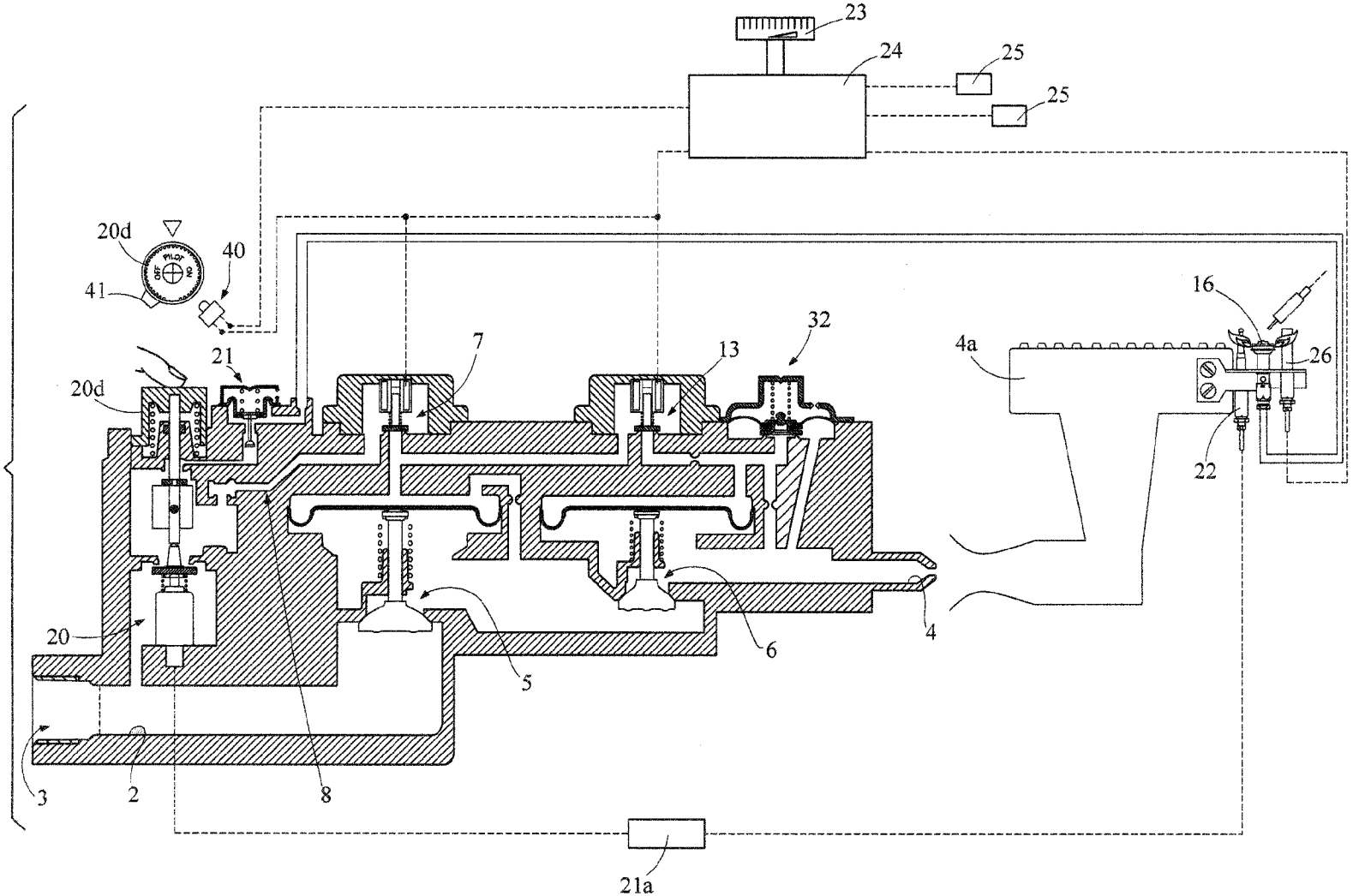
Figure 7:
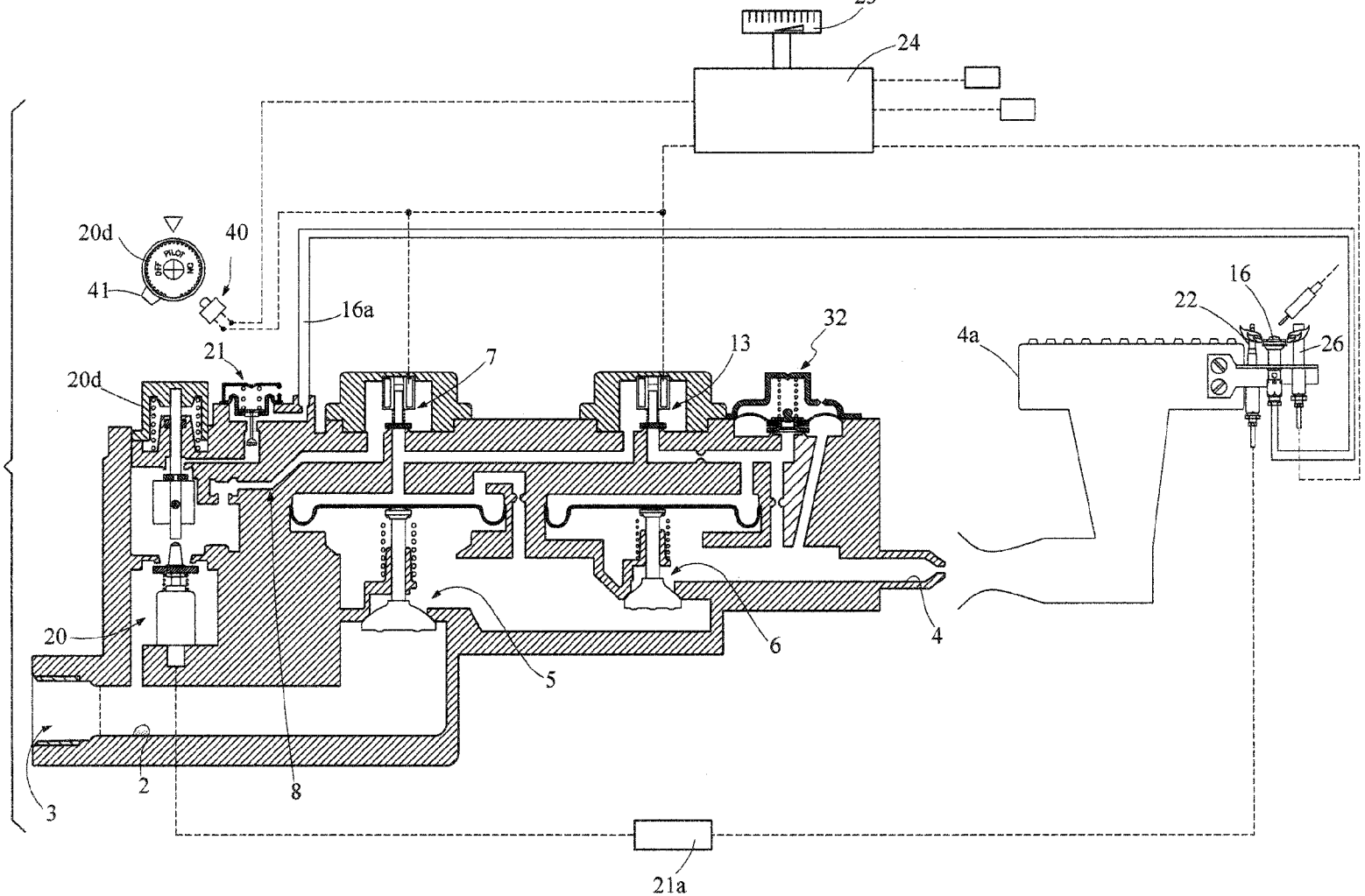
Figure 8:
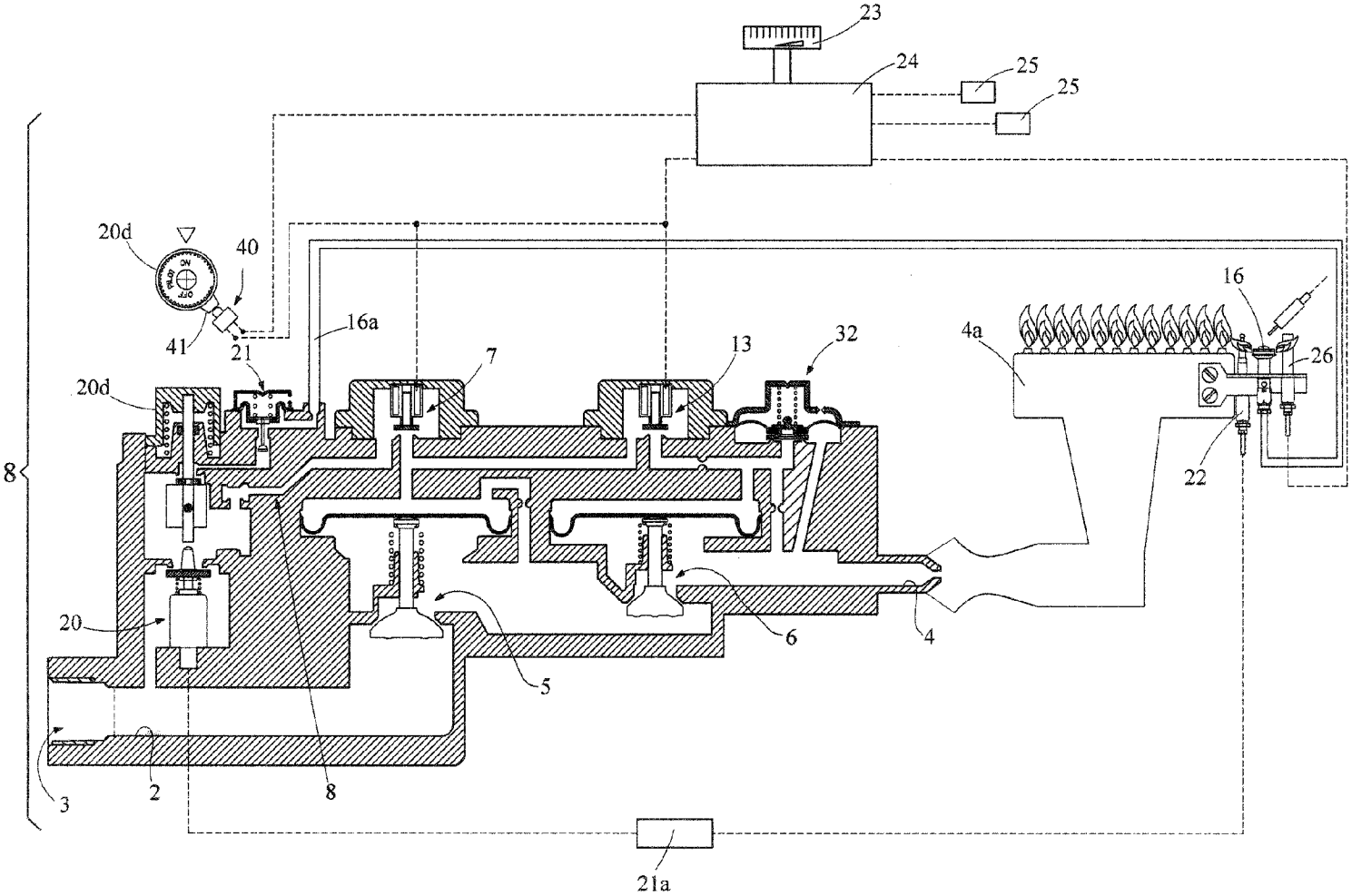

The inoperative condition shown in FIG. 5 is functionally equivalent to that shown in FIG. 1, in which the knob 20*d* in the OFF position, the electromagnets 11, 14 are de-energized, the intake pipes 8, 9 communicating with the control chambers are shut off (by the solenoid valves 7, 13 respectively), and the resilient return action of the springs 5*d*, 6*d* closes both valve seats 5*a*, 6*a* of the corresponding servovalves. In this condition, the knob 20*d* is in the closed position, with the valve seat 20*a* shut off, and the electromagnet of the magnetic safety unit 20 is de-energized (because no flame is present at the pilot thermocouple), and therefore the valve seat 18 is shut off.

When a burner ignition request is received, the magnetic safety unit 20 is first activated, with the opening of the valve seat 18 and the simultaneous ignition of the pilot burner 16. In this stage (shown in FIG. 6, with the knob set to PILOT), the gas flows along the pilot pipe 16*a*, by the bleeding of gas from the inlet section 3 along the portions 18' and 18" of the auxiliary pipe and through the seats 18 and 20*a*. In this stage of ignition of the pilot burner, the gas can flow along the first part of the intake pipe 8, but the flow is stopped by the closing of the shut-off member 12 on to its valve seat, since the electromagnets 11, 14 are de-energized (because the corresponding power supply circuits are open), thus closing the valve seats 5*a*, 6*a*.

When the unit 20 has been activated by the energizing of its electromagnet by the voltage generated by the thermocouple 22 which is heated by the flame at the pilot burner 16, following the correct ignition of the pilot burner (the stage shown in FIG. 3), the main burner 4*a* is ignited, in accordance with the program mode or the temperature selected by the knob element 23. For this purpose, the knob is first rotated to the ON position of FIG. 8, in which the appendage 41 interferes with the switch 40, thus switching it and closing the power supply circuit of the solenoid valves 7, 13, and consequently opening the corresponding valve seats 12, 15 and allowing gas to flow in the pipes 8*b*, 9 of the auxiliary line for supplying the servovalve control circuit.

In the normal operating condition, the rotation of the knob 20*d* to the OFF position causes the main gas passage to be closed by the opening of the switch 40 and the de-energizing of the electromagnets 11, 14. Additionally, when the flame ceases to be present at the pilot burner, the magnetic safety unit acts to close the shut-off member 18 and consequently shut off the gas passage in the auxiliary and main pipes.

Finally, it should be noted that, in both of the examples described above, the magnetic safety unit 20 can also be activated electrically (in addition to the manual activation), for what is known as "intermittent pilot" operation.

Thus the invention achieves the proposed objects while providing the aforementioned advantages over the known solutions.

The invention claimed is:

1. A device for controlling the supply of a combustible gas to a burner apparatus, comprising a main gas supply pipe in which are disposed a first and a second servovalve, respectively in cascade with each other, with respect to the direction of flow of the gas, said servovalves including respective valve seats associated with a corresponding shut-off member with diaphragm control for the opening of said seats in opposition to respective resilient return member, said first and second servovalve comprising a respective first and second control solenoid valve with an electromagnetic operating device that controls the opening/closure of the corresponding servovalve, said solenoid valves being arranged to act for opening/closure of pipes of respective servo-assisted control circuits, so as to control indirectly, by way of the diaphragm control, the respective shut-off member of the corresponding servovalve, the pipes of the control circuit placing the main pipe in fluid communication with respective control chambers of the servovalves, one side of the diaphragms of said diaphragm controls being subjected to the pressure existing in the respective control chamber, both of the intake pipes of the respective control circuits, capable of picking up the pressure signal to be transmitted to the corresponding control chamber, being respectively connected, in fluid communication, with the main pipe, upstream of the first servovalve, through an auxiliary bleed pipe which is branched from the main pipe, a pilot pipe is branched from the auxiliary pipe to supply a pilot burner, and a thermoelectric magnetic safety unit with a manual activating knob is provided on said auxiliary pipe, said unit acting on the pilot pipe so as to allow gas to flow towards the pilot burner when the unit is activated, while simultaneously shutting off the flow of gas towards the servovalve control circuit, and;

a control mechanism that controls the flow of gas to the control circuit, the control mechanism being controlled by the knob of said magnetic unit in operation, in order to open selectively the flow of gas towards the pipes of the servovalve control circuit, after the magnetic unit has been activated and when a flame is present at the pilot burner.

2. A device according to claim 1, wherein said control mechanism comprises a valve for shutting off the intake pipe in the control circuit upstream of said solenoid valves, the shut-off member of said valve being capable of being operated to open the respective valve seat, in opposition to a resilient return member, by contact with a projection which is fixed to said knob with respect to rotation and which interferes with said shut-off member in a predetermined angular position of the knob.

3. A device according to claim 2, wherein the auxiliary pipe comprises, from the section communicating with the main pipe onwards, a first portion of pipe extending into a second portion through an interposed valve seat, on which said manually activated thermoelectric magnetic safety unit acts, said second portion branching, downstream of said interposed valve seat, into a pilot pipe, through a second interposed valve seat, and into the control circuit intake pipe, through a third interposed valve.

4. A device according to claim 1, wherein said control mechanism comprises a switch which acts on the electrical supply circuit of the solenoid valves and which can be switched selectively for the opening/closure of said circuit by a projection from said knob or a shaped portion of the knob which can interfere with the switching element of said switch in order to operate it in a predetermined angular position of the knob.

5. A device according to claim 4, wherein the auxiliary pipe comprises, from the section communicating with the main pipe onwards, a first portion of pipe extending into a second portion through an interposed valve seat, on which said manually activated thermoelectric magnetic safety unit acts, said second portion branching, downstream of said seat, into a pilot pipe through a further interposed valve seat, and into the control circuit intake pipe, said switch being capable of selectively opening the flow of gas by energizing said solenoid valves, thus opening the respective valve seats, when said magnetic unit has been activated, and when a flame is correspondingly present at the pilot burner, so as to allow the opening of the main gas passage towards the main burner.

6. A device according to claim 1, wherein said magnetic safety unit can also be activated electrically, for operation in an intermittent pilot mode.

* * * * *